US007294099B2

(12) United States Patent
Schenk

(10) Patent No.: US 7,294,099 B2
(45) Date of Patent: Nov. 13, 2007

(54) STRETCHING EXERCISE APPARATUS AND METHODS

(76) Inventor: Peter Schenk, 2730 Daybreaker Dr., Park City, UT (US) 84098

( * ) Notice: Subject to any disclaimer, the term of this patent is extended or adjusted under 35 U.S.C. 154(b) by 198 days.

(21) Appl. No.: 11/034,222

(22) Filed: Jan. 12, 2005

(65) Prior Publication Data

US 2006/0160683 A1 Jul. 20, 2006

(51) Int. Cl.
*A63B 23/00* (2006.01)

(52) U.S. Cl. ..... 482/148; 482/142; 482/126

(58) Field of Classification Search ..... 482/142, 482/140, 62, 126–130, 105, 139, 143, 907, 482/72; D21/692, 665, 676, 686
See application file for complete search history.

(56) References Cited

U.S. PATENT DOCUMENTS

| | | | | |
|---|---|---|---|---|
| 1,973,945 | A | | 9/1934 | Chavin et al. |
| 2,405,024 | A | | 7/1946 | Eynon |
| 2,454,656 | A | | 11/1948 | Kollman |
| 2,470,544 | A | | 5/1949 | Bell |
| 2,544,106 | A | | 3/1951 | Ray |
| 2,973,029 | A | | 2/1961 | Schlosstein |
| 3,380,737 | A | | 4/1968 | Elia et al. |
| 4,084,810 | A | | 4/1978 | Forsman |
| 4,429,871 | A | | 2/1984 | Flechner |
| 4,583,731 | A | | 4/1986 | Crivello et al. |
| 4,632,393 | A | | 12/1986 | Van Noord |
| 4,700,946 | A | * | 10/1987 | Breunig ..... 482/57 |
| 4,743,010 | A | | 5/1988 | Geraci |
| 4,819,936 | A | | 4/1989 | Muller |
| 4,840,372 | A | * | 6/1989 | Oglesby et al. ..... 482/9 |
| 4,883,268 | A | | 11/1989 | Salkind |
| 5,108,090 | A | | 4/1992 | Reed |
| 5,110,121 | A | | 5/1992 | Foster |
| 5,178,599 | A | | 1/1993 | Scott |
| 5,184,991 | A | | 2/1993 | Brangi |
| 5,288,130 | A | | 2/1994 | Foster |
| 5,299,997 | A | | 4/1994 | Chen |
| 5,299,998 | A | | 4/1994 | Hutchins |
| 5,322,489 | A | | 6/1994 | Webb et al. |

(Continued)

FOREIGN PATENT DOCUMENTS

| | | |
|---|---|---|
| DE | 1929340 | 6/1968 |

OTHER PUBLICATIONS

Pollock et al.,*ACSM Position Stand on the The Recommended Quantity and Quality of Exercise for Developing and Maintaining Cardiorespiratory and Muscular Fitness, and Flexibility in adults*, Med. Sci. Sports Exerc., vol. 30, No. 6, pp. 975-991, 1998.

(Continued)

*Primary Examiner*—Lori Amerson
(74) *Attorney, Agent, or Firm*—Pate Pierce & Baird

(57) ABSTRACT

An apparatus and method for improving flexibility in a user. The apparatus may include: a base frame having forward lateral, medial, and rear lateral supports; a post having a flexible joint and an upper extremity support; and a user support assembly having forward, rear, foot supports. If desired, the post may provide a plurality of non-fixed, upper extremity positions and recoiling from same. The user support assembly may provide a plurality of non-fixed pivot points for conducting compounded progressive stretching of at least one muscle group.

16 Claims, 17 Drawing Sheets

U.S. PATENT DOCUMENTS

| | | | | |
|---|---|---|---|---|
| 5,342,269 | A | 8/1994 | Huang et al. | |
| 5,527,248 | A | 6/1996 | Crivello | |
| 5,565,002 | A * | 10/1996 | Rawls et al. | 482/6 |
| 6,117,055 | A * | 9/2000 | Boland | 482/121 |
| 6,752,745 | B1 * | 6/2004 | Davis | 482/72 |
| 2002/0077221 | A1 * | 6/2002 | Dalebout et al. | 482/57 |
| 2003/0203791 | A1 * | 10/2003 | Chen | 482/57 |

OTHER PUBLICATIONS

Precor USA, *C240i Commercial Stretch Trainer*, product brochure, 2004, www.precor.com.

Appleton, *Stretching and Flexibility-Flexibility*, Aug. 16, 2004, pp. 1-6, http://www.cmcrossroads.com/bradapp/docs/rec/stretching/stretching_3.html.

Appleton, *Stretching and Flexibility-Types of Stretching*, Aug. 16, 2004, pp. 1-8, http://www.cmcrossroads.com/bradapp/docs/rec/stretching/stretching_4.html.

* cited by examiner

STRETCHING EXERCISE APPARATUS AND METHODS

BACKGROUND

1. The Field of the Invention

The present invention relates generally to apparatus and methods for exercising by a user and more specifically to apparatus and methods for conducting flexibility or stretching exercises.

2. The Background Art

In most accounts, cultural belief in the necessity of physical fitness programs for the general population is a relatively new concept in history. The concept of conducting a regular physical fitness program emerged in the first half of the $20^{th}$ Century and popularity of such programs has steadily progressed. The need for regular physical fitness may be a reflection of the fundamental shift from agrarian to industrial and urban societies over the previous 100 years. As the need to hunt, cultivate, and gather food has been reduced within a culture, the amount of physical activity associated with these activities has correspondingly decreased.

The decrease in overall physical activity has led to the development of numerous public health concerns. Currently, obesity and musculoskeletal disorders are two of the most pressing health problems in the United States. Lack of or reduced physical activity may be a significant factor in both of these conditions as well as many other health related conditions. Currently available prior art methods and apparatus have been variously successful and unsuccessful in meeting these challenges. The development and availability of effective, economical, and safe apparatus and methods for improving physical fitness is needed and of paramount importance to society.

Societal efforts to investigate and improve physical fitness began in earnest in the 1950s. Shortly after the introduction and general acceptance of television in the 1950s, the first television based exercise programs appeared. One of these programs was hosted by fitness expert, Jack La Lanne. Also, in 1954, the American College of Sports Medicine (ACSM) was founded to promote scientific investigation, research, and education in sports medicine and exercise science. In addition, ACSM helps to set and maintain standards for physical performance, fitness, health, and quality of life.

Two important characteristics, cardiovascular fitness (i.e., aerobic conditioning) and muscular strength fitness (i.e., anaerobic conditioning), have subsequently long been recognized in the prior art as goals for physical fitness programs. Prior art apparatus and methods to improve muscle strength and anaerobic conditioning include, for example, training with free weights (e.g., dumbbells, barbells, universal machines); resistance training; and isometric training.

Prior art apparatus and methods directed to improving cardiovascular fitness have largely focused on exercises replicating walking, jogging, stair climbing, rowing, and the like. Recently, ACSM released a position stand indicating that flexibility should be considered as a third major component to fitness and exercise programs (see, ACSM Position Stand on The Recommended Quantity and Quality of Exercise for Developing and Maintaining Cardiorespiratory and Muscular Fitness, and Flexibility in adults, *Med. Sci. Sports Exerc.*, Vol. 30, No. 6, pp. 975-991, 1998 incorporated herein by reference).

Although numerous apparatus exist for improving cardiovascular fitness and muscle strength, few prior art apparatus are directed solely to improving flexibility in a user. Apparatus and methods for improving flexibility include Pilates programs, antdyonizer, floor exercise programs, dance bars mounted on walls, and web-like cages with multiple placement sites for limbs. These prior art methods require that at least one portion of a users body be anchored or fixed to a specific point.

Moreover, many apparatus use positions that require that muscles be stressed in supporting the body while ostensibly being stretched. Muscles and tendons should have no stress (be unloaded) and relaxed when stretched. Accordingly, a limitation exists on the overall amount and quality of flexibility exercise achieved using available apparatus and methods for improving flexibility and range of motion.

In addition, the available prior art apparatus and method do not target all muscle groups or each group in turn in a user. Instead, muscle groups are not considered, may be disproportionately extended, or may be disproportionately loaded, all effectively limiting the utility of stretching. Moreover, they lack a dynamic movement that allows more than one muscle group to be stretched or have a limitation on the total range of motion that can be achieved in a user.

What are needed are effective, economical, and safe apparatus and methods for improving physical fitness by focusing on dynamic flexibility and stretching in a user and allowing greater range of motion to be achieved. What are also needed are effective, economical and safe apparatus and methods to provide unloaded, relaxed, stretching; in preparation for aerobic exercises, strength training, or therapies for decreasing obesity. Such are particularly needed for reducing harmful lower back conditions caused by other stretching methods that require one muscle group to support itself or others to accomplish stretching.

OBJECTS AND BRIEF SUMMARY OF THE INVENTION

In view of the foregoing, it is a primary object of the present system and series of inventions to provide apparatus and methods for stretching exercise and improvement of physical fitness by increasing flexibility and range of motion. In the foregoing respects, the stretching exercise apparatus and methods according to the invention improve the amount and quality of flexibility that can be achieved in a user.

It is another object of the present inventions to provide apparatus and methods for stretching exercise and improvement of physical fitness that do not require a bodily member of a user to be anchored to a fixed point.

It is a further object of the present inventions to provide apparatus and methods for stretching exercise and improvement of physical fitness that improve the range of motion a user may achieve in a stretching exercise.

In addition, it is an object of the present inventions to provide apparatus and methods for stretching exercise and improvement of physical fitness wherein a user may dynamically stretch multiple muscle groups, including neck, shoulder, arm, chest, back, abdomen, leg, and calf.

Additionally, it is an object of the present inventions to provide apparatus and methods for stretching exercise and improvement of physical fitness that have a flexibility capable of generating a greater range of motion in a user during exercise stretching.

It is another object of the present inventions to provide apparatus and methods for stretching exercise and improvement of physical fitness wherein recovery or recoil of an exercise device or assembly may urge a return to a starting position drawing a user toward a starting position when a user shifts his or her center of gravity.

It is a still further object of the present inventions to provide apparatus and methods for stretching exercise and improvement of physical fitness in which a user may reduce conditions associated with obesity.

Also, it is an object of the presents invention to provide apparatus and methods for accomplishing stretching exercise and improvement of physical fitness that reduce the occurrence of lower back pain in a user.

Additionally, it is another object of the present inventions to provide apparatus and methods for stretching exercise and improvement of physical fitness wherein posture and balance may be improved in a user.

It is another object of the present inventions to provide apparatus and methods for stretching exercise and improvement of physical fitness to reduce stress and muscle aches and pains in a user.

It is a further object of the present inventions to provide apparatus and methods for stretching exercise and improvement of physical fitness that may improve circulation in a user and allow for improved recovery following surgery.

In addition, it is an object of the present inventions to provide apparatus and methods for stretching exercise and improvement of physical fitness wherein a user may reduce musculoskeletal conditions associated with chronic conditions.

It is a still further object of the present inventions to provide apparatus and methods for stretching exercise and improvement of physical fitness wherein a center of gravity in a user may be displaced to assist and improve amount and quality of stretching exercise.

Also, it is an object of the present inventions to provide apparatus and methods for stretching exercise and improvement of physical fitness by compounding stretching exercises and making such exercises progressively effective according to a user's size, strength, condition, and accumulated flexibility.

Additionally, it is an object of the present inventions to provide apparatus and methods for stretching exercise and improvement of physical fitness which provides gravity-augmented passive (muscles not working against one another) stretching.

It is another object of the present inventions to provide apparatus and methods for stretching exercise and improvement of physical fitness wherein reduction in muscle tension (loading, stress) and improved muscle relaxation may be achieved by removing the requirement on a muscle to support a force or load while being stretched for improving flexibility.

Consistent with the foregoing objects, and in accordance with the various related inventions as embodied and broadly described herein, apparatus and methods for stretching exercise and improvement of physical fitness are disclosed. One embodiment of an apparatus in accordance with the invention may include a base frame, a post and a user support assembly. The base frame may include forward and rear lateral supports extending outward from a center or medial support.

The post may include a support (e.g., handle bar) for a user's hands and arms and a recoil assembly designed to return the post to a starting position. The recoil assembly may also increase safety and reduce the risk or injury for those using the device by significantly reducing the jerking in the arms and shoulders that accompanies a rigid handlebar. The user assembly may include a forward and rear padded seat and foot support plate. In practice, the user support assembly may pivot on the base frame and the user may shift center of gravity by dynamically altering the position of at least four pivot points.

One embodiment of a method for stretching exercise and improvement of physical fitness in accordance with the present invention may include providing an apparatus for compounding exercise to relax and engage in stretching a muscle or group. It may include progressive stretching wherein a user may increase stretching according to a user's improved ability. One embodiment provides gravity-augmentation by using the user's weight to promote stretching. Passive stretching does not require force loading in a muscle being stretched in the user. Mounting the gravity-augmented passive stretching apparatus conducting the gravity-augmented passive stretch may improve flexibility, posture, and balance in a user. A user may displace the center of gravity of the body by displacement of a hand pivot, assembly pivot, seat pivot, and a foot pivot to engage more or less gravity assistance, thus not needing another assistant or the muscles in question themselves.

BRIEF DESCRIPTION OF THE DRAWINGS

The foregoing and other objects and features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which.

DETAILED DESCRIPTION OF THE PREFERRED EMBODIMENTS

Figure 1:
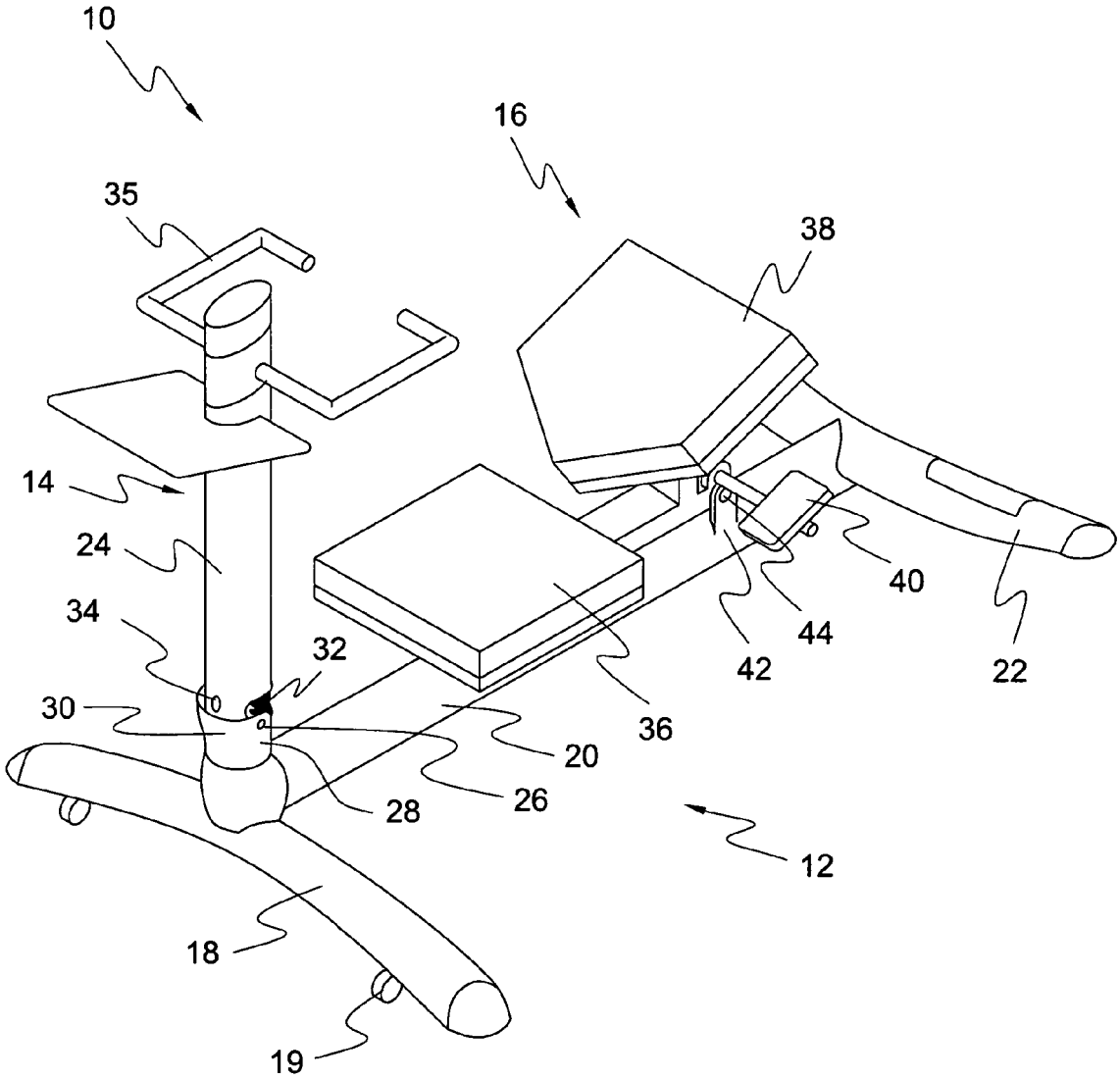
FIG. 1 is a front left quarter perspective view of one embodiment of an apparatus in accordance with the invention wherein the apparatus is in starting position.

It will be readily understood that the components of the present invention, as generally described and illustrated in the Figures herein, could be arranged and designed in a wide variety of different configurations. Thus, the following more detailed description of the embodiments of systems and methods in accordance with the present invention, as represented in FIGS. 1 through 17, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

For the purposes of establishing definition support for various terms used in the present application, Applicant provides the following technical comments and review.

The term "flexibility" may be used synonymously with "range of motion" and may designate an ability in a user to have plasticity and pliance in the musculoskeletal system, especially in joints and muscles. A range of motion is typically limited by the extension.

The term "exercise" may be used synonymously with conditioning and may designate a practice of regular repeated use of muscles and bones to develop and maintain physical fitness. Accordingly, exercise may include anaerobic (strength) conditioning, aerobic (cardiovascular) conditioning, and flexibility conditioning.

The term "stretching" may designate the use of force to distend a muscle, group of muscles, or at least one muscle and joint. Stretching may be referred to as an exercise to improve the flexibility or range of motion in muscles and joints. There are many types of stretching exercises, including for example and not by limitation, ballistic stretching, dynamic stretching, active stretching, passive stretching, static stretching, isometric stretching, and proprioceptive neuromuscular facilitation (PNF) stretching. Passive stretching may sometimes be referred to a relaxed stretching or static-passive stretching, and involves the use of another part of the body or an apparatus for holding a specific stretching position. For example, and not by way of limitation, the practice of "splits" is a passive stretch utilizing the floor or other hard surface to hold the legs and hip in a split position. Gravity may also be used as an apparatus for purposes of conducting a passive stretching exercise. Accordingly, the term "gravity-augmented" may designate the use of an apparatus configured to utilize gravity and the shifting of center of gravity of a user in order to provide the force needed to increase the range of motion generated in a stretching exercise program rather than or in addition to force applied by another person, muscle group, or the exercised muscles themselves.

The term "compounded progressive stretching" may designate the use of an apparatus to provide additional pressure to the musculoskeletal system to improve the range of motion in a user. Progressive refers to the property of using a series of stages to advance the range of motion achieved by a user. Compound or compounded refers to the ability to engage a muscle group together. A compounded progressive exercise may include multiple types of stretching, including, but not limited to, ballistic, dynamic and passive stretching to gradually extend the range of motion in a user.

Figure 2:
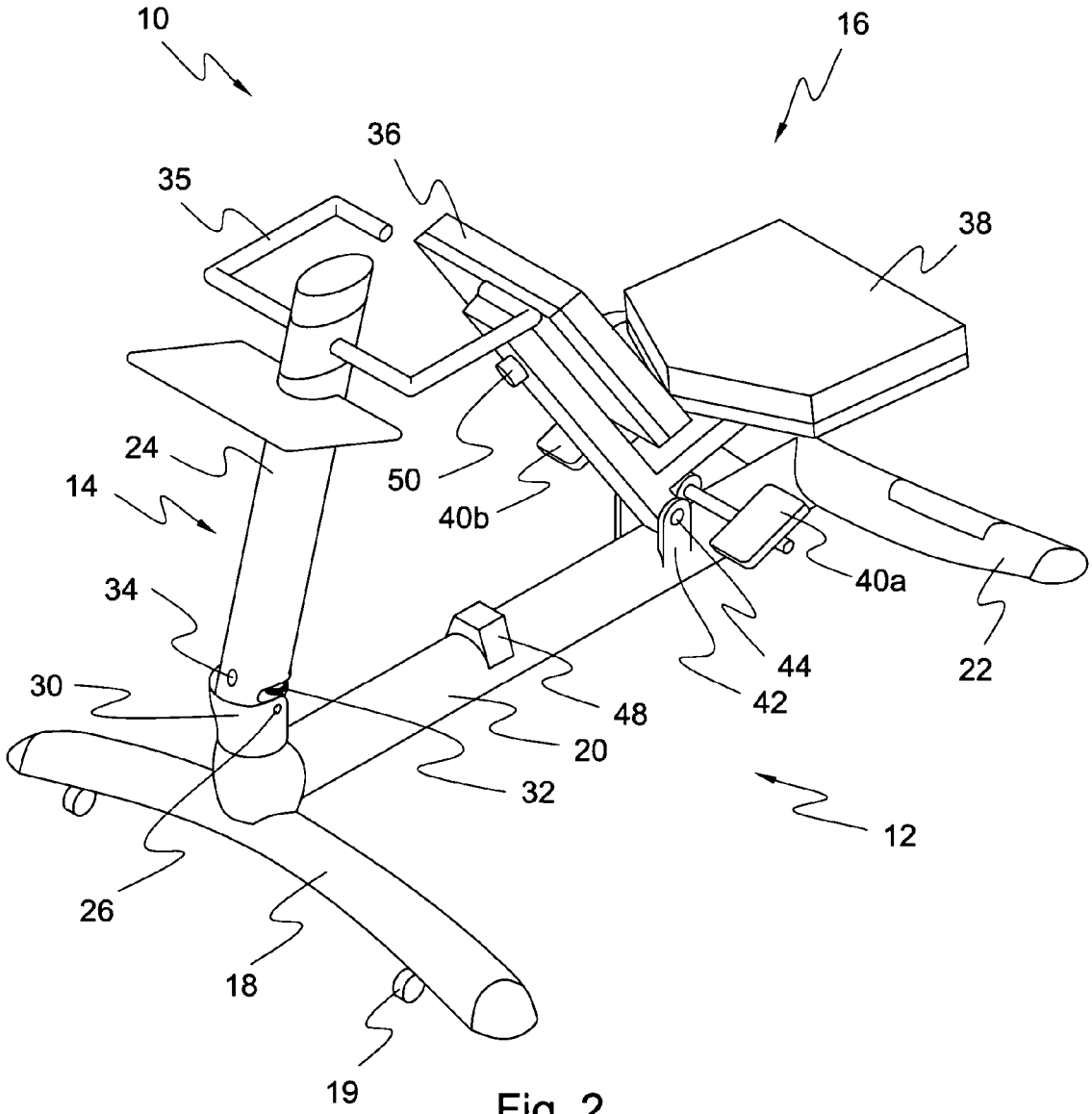
FIG. 2 is a front left quarter perspective view of one embodiment of an apparatus in accordance with the invention wherein the apparatus is in full-back position.

Referring now generally to FIGS. 1 and 2 and specifically to FIG. 1, one embodiment in accordance with the present invention of an apparatus 10 for conducting compounded progressive stretching exercise may be formed to include a base frame 12, a post 14, and a support assembly 16. A base frame 12 may further include a forward support 18, a medial support 20, and a rear support 22. A forward support 18, may also have at least one wheel 19 providing for easier storage and retrieval of the apparatus 10 prior to use. A base frame 12 may be formed from any material readily known, including, for example and not by limitation, metal, wood, plastic, composite, and fiberglass.

A base frame 12 may include a forward support 18, a medial support 20, and a rear support 22 that may be formed in a generally arcuate shape. An arcuate shape is not required in the invention, but may assist a user in producing a greater range of motion.

A post 14 may include a top post 24, a joint 26, a bottom post 28, a pinch sleeve 30, a spring 32, a recoil bumper 34, and an upper extremity support 35. A top post 24 and bottom post 28 are flexibly connected by a joint 26. In resting position, a spring element 32, such as a spring 32 provides sufficient force to urge the top post 24 and bottom post 28 into a generally upright position. A pinch sleeve 30 provides protection for a user from movement of the joint 26 and a recoil bumper 34 may minimize damage to the pinch sleeve during operation of the apparatus 10. A post 14 may be formed from any material readily known, including, for example and not by limitation, metal, wood, plastic, composite, and reinforced materials such as fiberglass.

A joint 26 may have any suitable configuration to provide the desired flexure. For example, if desired or necessary, the spacing between the top post 24 and the bottom post 28 may be sufficient to allow the top post 24 to pivot at the joint 26 to an angle of ninety degrees with respect to the bottom post 28. This provides great rearward deflection of the top post 24 and allows a user to move backward and down until the seat (rear support 38) contacts the floor. A spring 32 or other resilient biasing member 32 may be shaped and sized to accommodate such motion. Thus, the top post 24 may bend rather than pivot. Alternatively, the joint 26 and spring 32 may limit the flexure of the top post 24 with respect to the vertical to a desired angle such as thirty degrees, forty-five degrees, sixty degrees etc.

In one embodiment, the top post 24, joint 26, bottom post 28, pinch sleeve 30, and spring 32 may be replaced by a single post formed partially or entirely of a resiliently deflectable material. In such an embodiment, the entire post may perform the function of the spring 32 and permit deflection or bending of the post to a location within the reach of a user. Alternatively, the lower portion 28 may be formed of a flexible, resilient material. Moreover, the resilient nature of the post may urge the post into a generally upright position when not used or loaded by a user.

An upper extremity support 35 or handlebar 35 may be formed in a generally "U" shaped configuration. An upper extremity support 35 may include hand grips and may include a place for resting arms or shoulders.

A user support assembly 16 may have a forward support 36, a rear support 38, at least one foot support 40, a pivot bracket 42, and a pivot pin 44. As shown in FIG. 1, one embodiment of an apparatus 10 in accordance with the invention depicts the user support assembly 16 in a resting or starting position. A forward support 36 and a rear support 38 may be formed in any shape, but will commonly be in rectangular, polygonal, or circular shapes. In addition, a forward support 36 and a rear support 38 may be formed from foam, rubber, plastic, fiberglass, composites, wood, metal and the like and may optionally include a covering made of vinyl, plastic, fabric, leather, or other suitable material.

A user support assembly 16 may be configured so that the foot support 40 is located behind and optionally above the position of the pivot bracket 42 and pivot pin 44. In this location, a foot support 40 may have a rear displacement when an apparatus 10 is in operation by a user.

Still referring generally to FIGS. 1 and 2 and specifically to FIG. 2, one embodiment in accordance with the present invention of an apparatus 10 for conducting compounded progressive stretching exercise may be formed to include a base frame 12, a post 14, and a support assembly 16. As illustrated in FIG. 2, an apparatus 10 may have a full-back position. A post 14 may be flexed at a joint 26 so that the top post 24 and bottom post 26 form an angle less than 180 degrees along their rear surface.

A post 14 may be flexed by the force exerted by a user during operation of the apparatus 10. The spring element 32 may be compressed during flexion of the post. The recoil properties of the spring 32 will provide a force to return the post 14 starting position.

A user support assembly 16 is shown in a rearward position. Alternatively, the pivot 44 connecting the user support 16 to the base frame 12 may be positioned such that in a fully back position, the rear support 38 moves until it rests in contact with the ground or supporting surface behind the device 10. In either position, a user support assembly rest 48 and assembly bumper 50 may be exposed. Likewise, the top post 24 may deflect accordingly. In some embodiments, the top post 24 may deflect approximately ninety degrees. The assembly rest 48 may be located on the base frame 12 along the medial support 20. The assembly rest 48 is located in optimal position to contact with assembly bumper 50 as the user support assembly 16 returns to starting position. An assembly rest 48, and assembly bumper 50 may be formed of any readily available material, including for example and not by limitation, plastic, rubber, metal, wood, composite, fiberglass and the like.

Also depicted in this full-back position, the rear user support 38 is in actual contact or nearly contacting the ground surface behind the rear support 22 of the base frame 12. In addition, foot supports 40*a* and 40*b* may undergo a rearward displacement at least one centimeter and preferably several centimeters relative to the pivot bracket 42 and pivot pin 44.

In the full-back position as shown in FIG. 2, the top post 24, upper extremity support 35, forward user support 36, rear user support 38, and foot supports 40*a*, 40*b* may all undergo substantial displacements.

Figure 3:
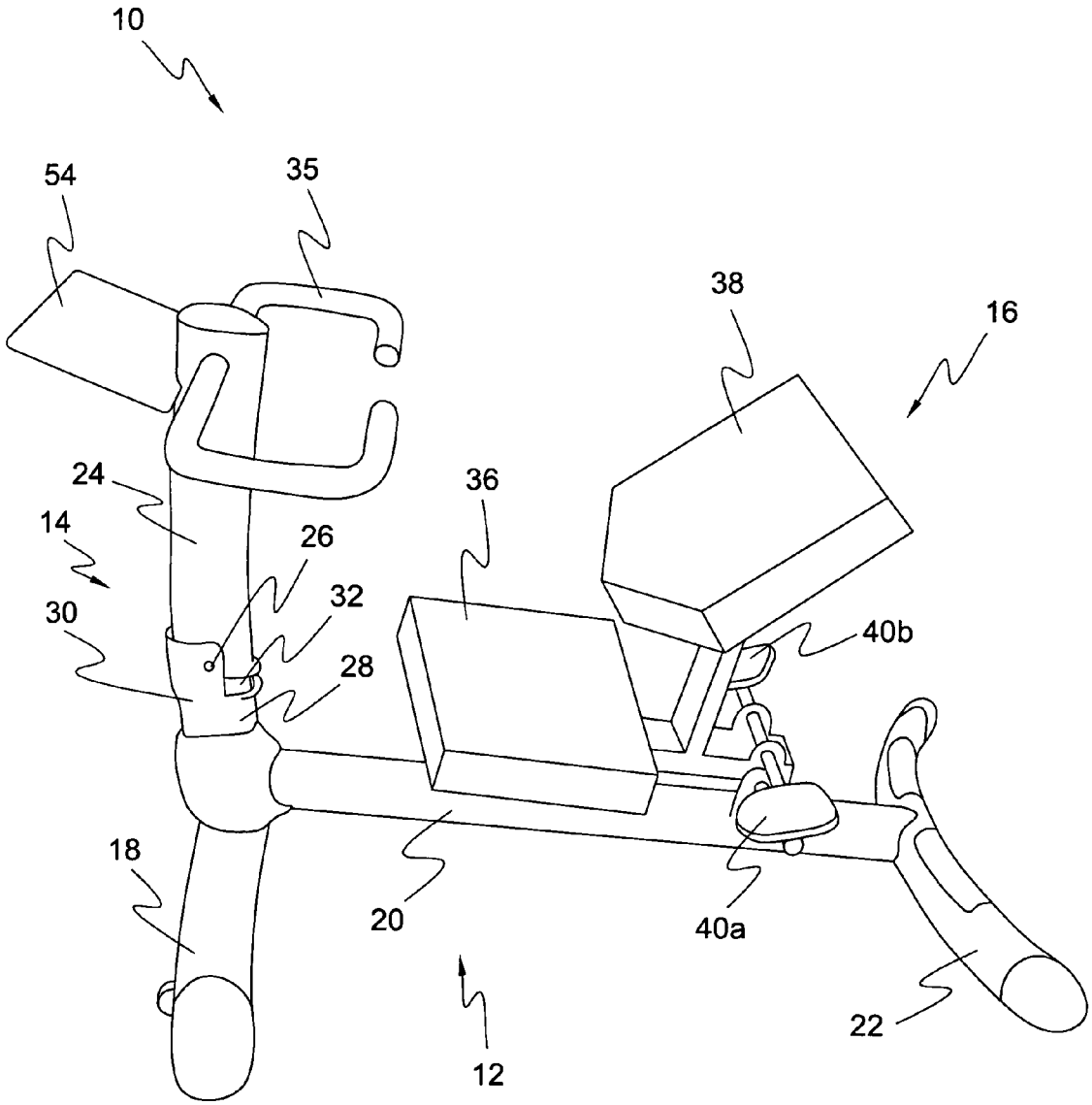
FIG. 3 is a left side elevation view of one embodiment of an apparatus in accordance with the invention wherein the apparatus is in starting position.
Figure 4:
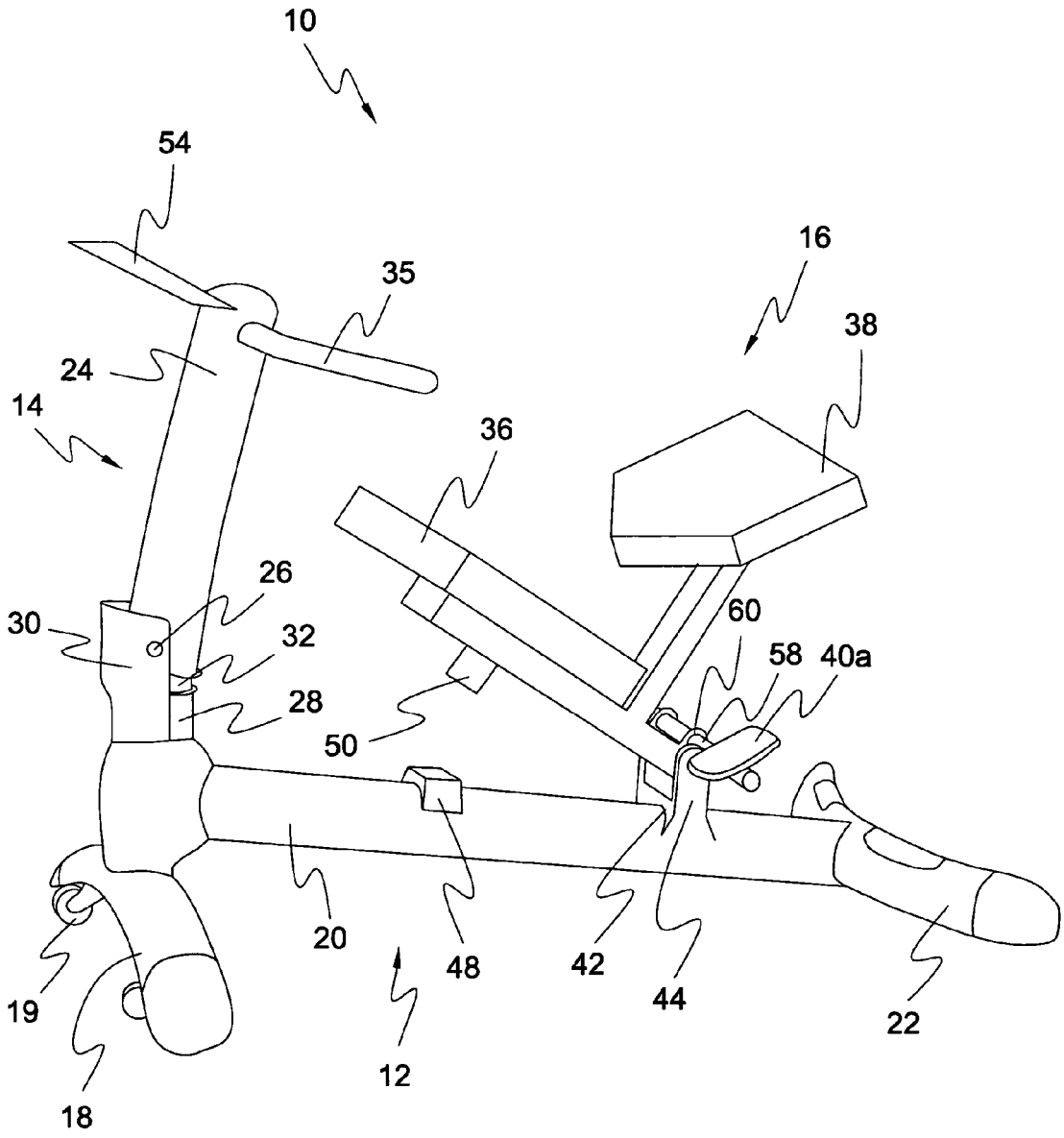
FIG. 4 is a left side elevation view of one embodiment of an apparatus in accordance with the invention wherein the apparatus is in half-back position.
Figure 5:
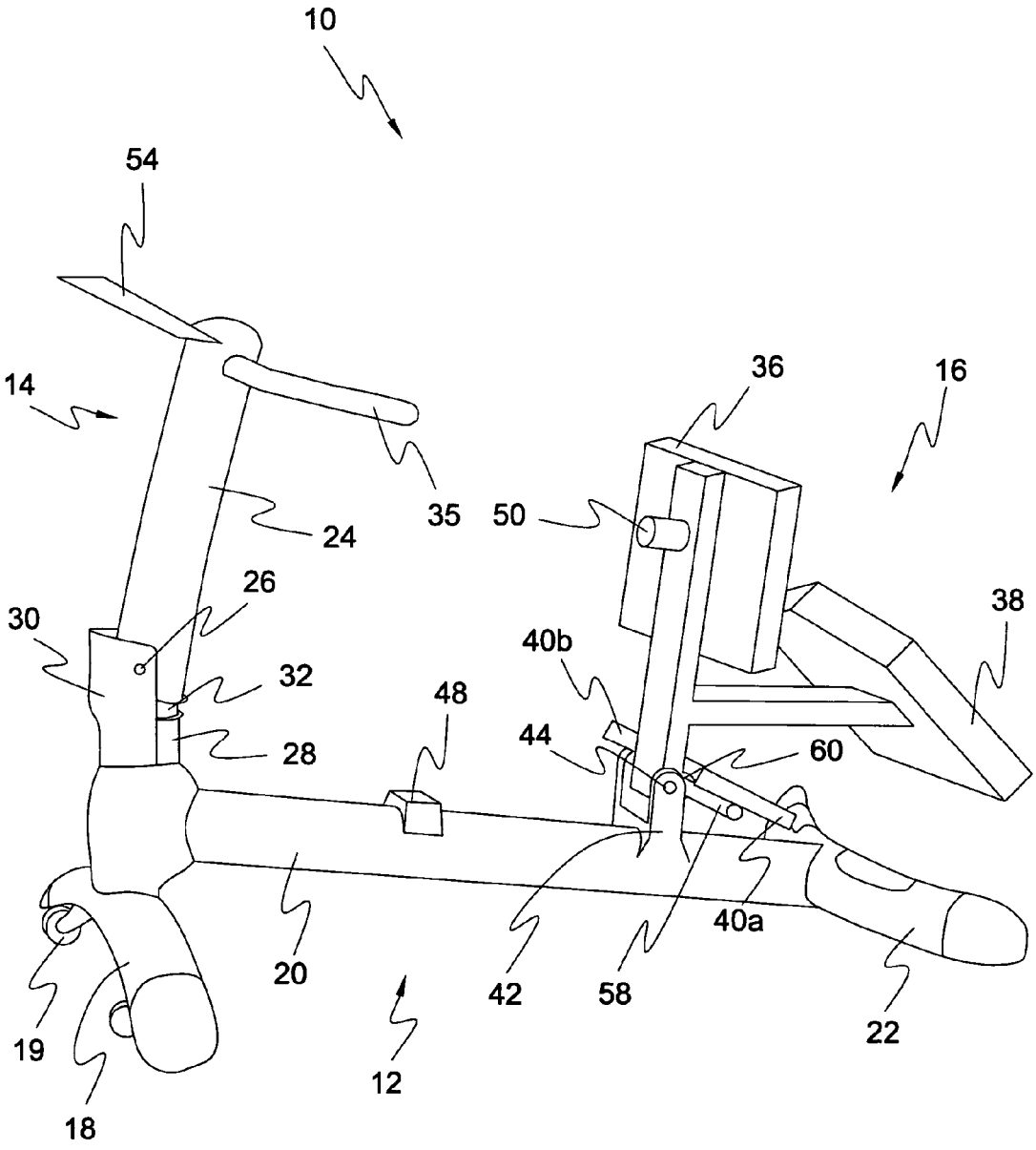
FIG. 5 is a left side elevation view of one embodiment of an apparatus in accordance with the invention wherein the apparatus is in full-back position.

Referring specifically to FIG. 3 and generally to FIGS. 3-5, one embodiment of an apparatus 10 in accordance with the present invention for conducting compounded progressive stretching exercise may be illustrated in a left side elevated view in a starting position as having a base frame 12, a post 14, and a user support assembly 16. A post 14 may optionally include a media holder 54 configured to hold a computer assembly, video monitor, newspaper, journal, book, instructional materials, or the like.

In this starting position, an apparatus 10 has a post 14 in a substantially upright position where the top post 24 and bottom post 28 define a generally straight line relative to the joint 30. In addition, in the starting position, foot supports 40*a*, 40*b* may be elevated slightly above and behind the pivot bracket 42 and pivot pin 44.

Now referring specifically to FIG. 4, and generally to FIGS. 3-5, one embodiment of an apparatus 10 in accordance with the present invention for conducting compounded progressive stretching exercise may be illustrated in a left side elevated view in a one-half way back position as having a base frame 12, a post 14, and a user support assembly 16.

In this one-half back position, an apparatus 10 has a post 14 in a partially flexed position where the top post 24 and bottom post 28 form an angle, typically less than 180 degrees relative to joint 30. In the one-halfback position, the top post 24 may be displaced in a rear direction by a few centimeters. In addition, in the one-half back position, the foot support 40 may joined to the user support assembly 16 by a pedal support 58 and a pedal bracket 60. The foot support 40 may be substantially equal in height and further to the rear of the pivot bracket 42 and pivot pin 44. The rear support 38 may be substantially above the rear support 22.

Specifically in FIG. 5 and generally in FIGS. 3-5, one embodiment of an apparatus 10 in accordance with the present invention for conducting compounded progressive stretching exercise may be illustrated in a left side elevated view in a full-back position as having a base frame 12, a post 14, and a user support assembly 16.

In this full-back position, an apparatus 10 has a post 14 in a fully flexed position where the top post 24 and bottom post 28 define an angle less than 180 degrees relative to joint 30 and an angle less than that found in the one-halfback position. In the full-back position, the top post 24 may be displaced in a rear direction by several centimeters. In addition, in the full-back position, the foot support 40 may joined to the user support assembly 16 by a pedal support 58 and a pedal bracket 60. The foot support 40 may be lower in height and substantially further to the rear of pivot bracket 42 and pivot pin 44. In addition, the rear support 38 may be behind the rear support 22 and substantially at ground level.

Figure 6:
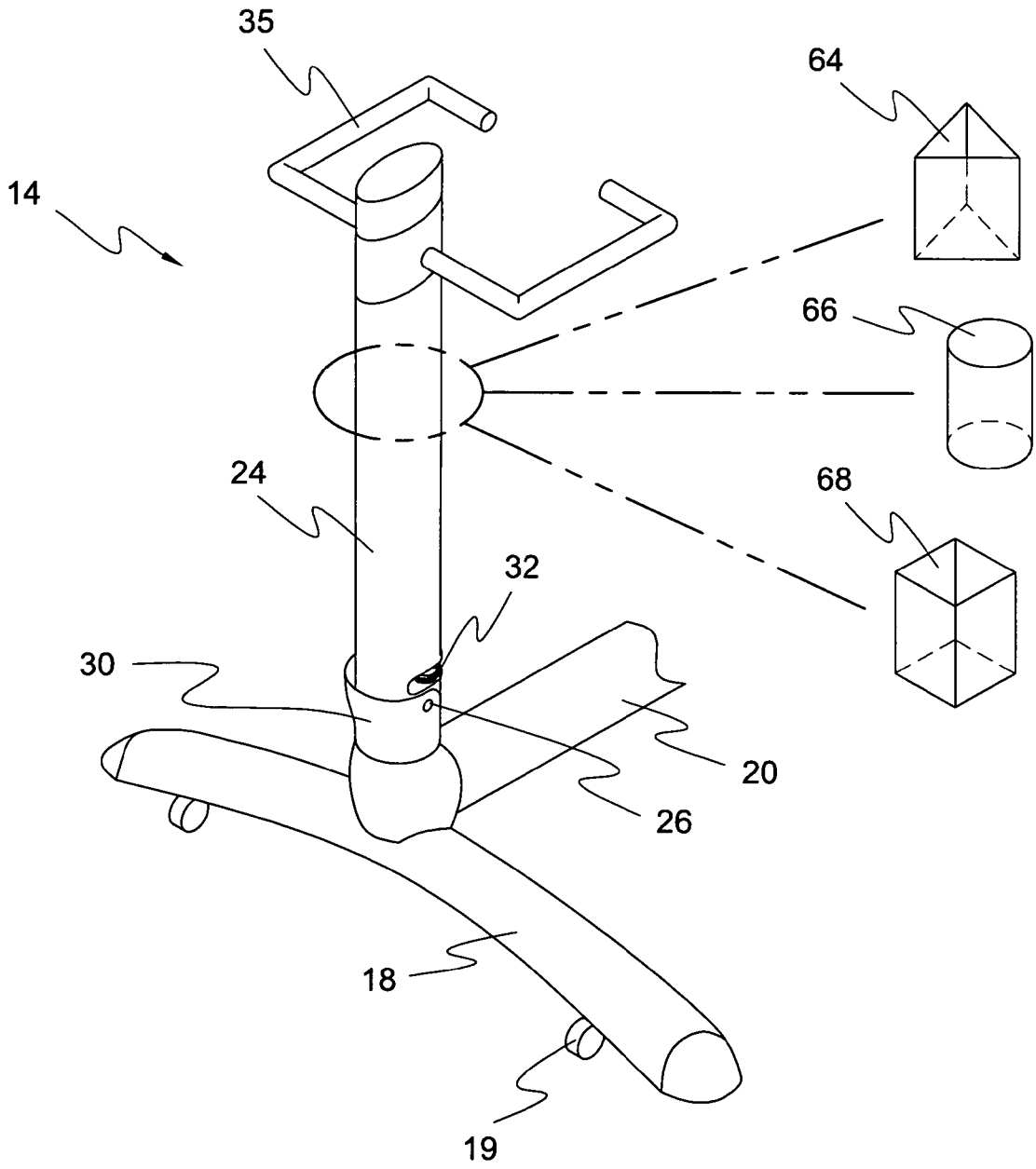
FIG. 6 is an exploded view of the post in one embodiment of an apparatus in accordance with the invention, illustrating alternative embodiments for the post configuration.
Figure 7:
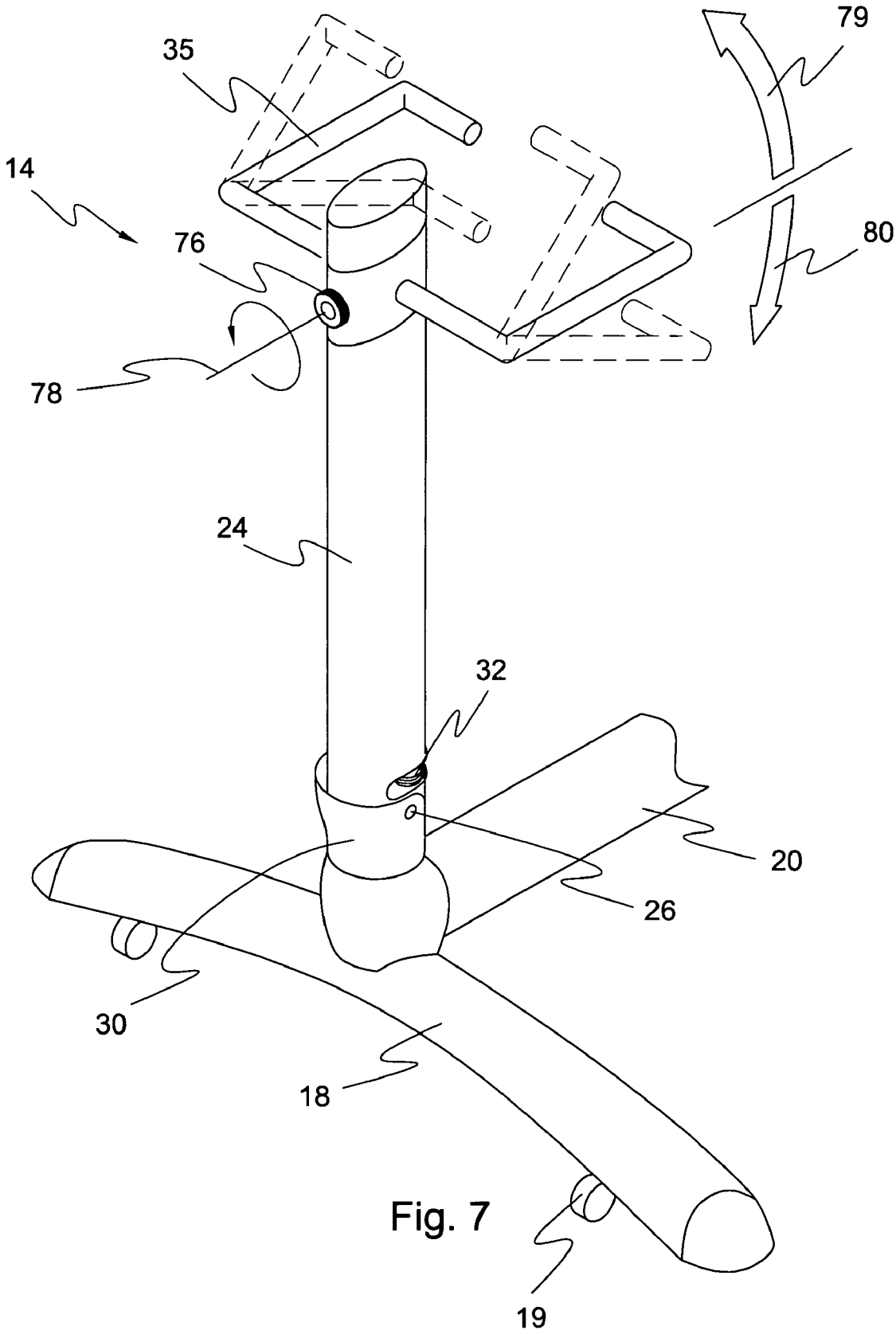
FIG. 7 is an exploded view of the post in one embodiment of an apparatus in accordance with the invention, illustrating alternative embodiments for the user upper extremity support and dynamic movement of the support.
Figure 8:
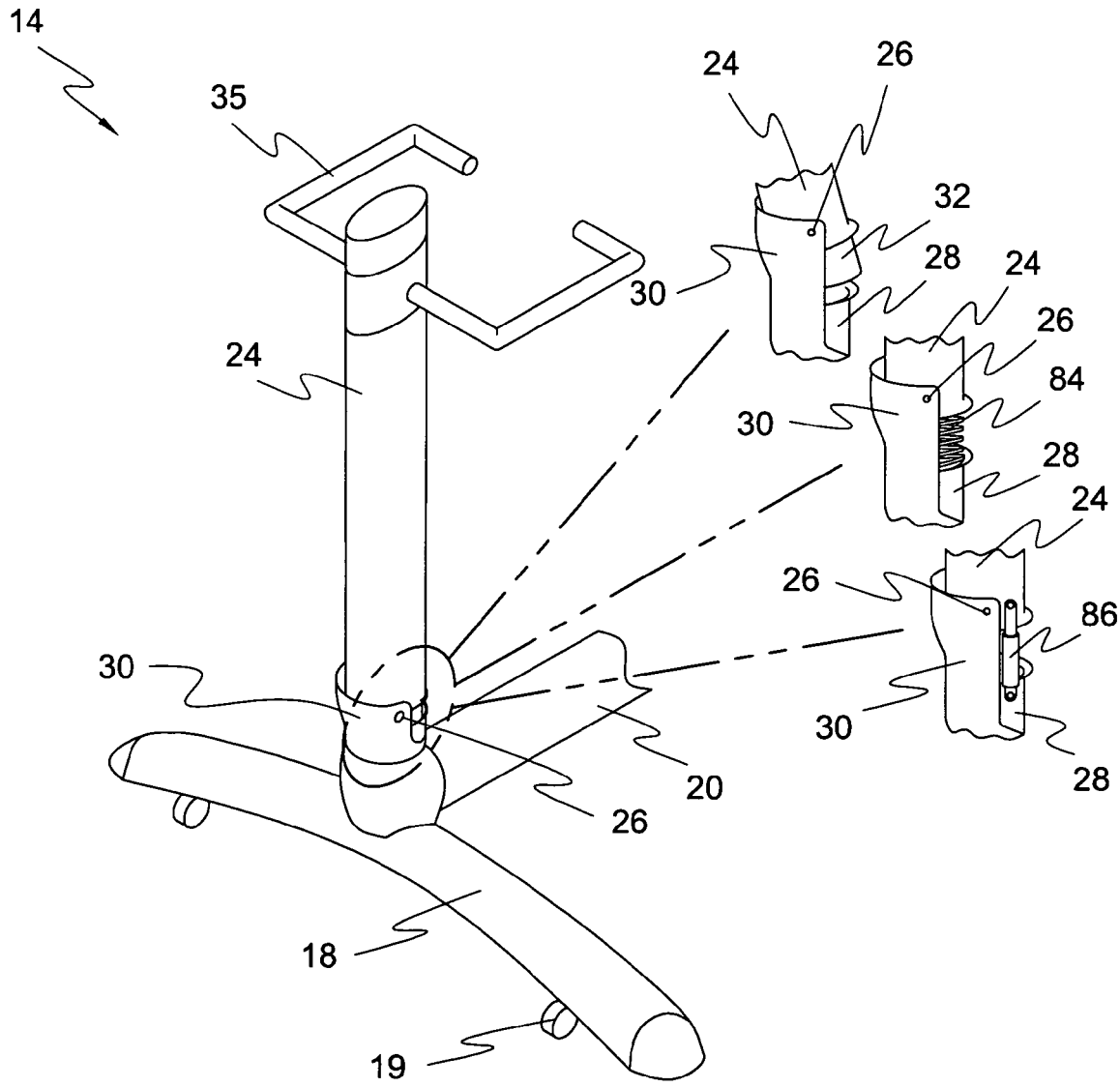
FIG. 8 is an exploded view of the post in one embodiment of an apparatus in accordance with the invention, illustrating alternative embodiments for the recoil assembly.

Referring generally to FIGS. 6-8, and specifically to FIG. 6, one embodiment of an apparatus 10 in accordance with the present invention for conducting compounded progressive stretching exercise may have multiple post 14 configurations. As depicted in FIG. 6, a post 14, may have a top post 24, joint 26, bottom post 28, pinch sleeve 30, spring 32, recoil bumper 34, and upper extremity support 35; all of which are located substantially directly above the forward support 18 or medial support 20. A post 14 may have any of several types of post 14 shapes. In one embodiment, as shown generally in FIG. 6, a post 14 may have a substantially oval shape. In alternative embodiments, a post 14 may have a triangular shape 64, circular shape 66, or rectangular shape 68. It is contemplated that the post 14 shape is configured in a manner to optimize the amount and quality of stretching that a user may achieve while using an apparatus 10 for compounded progressive stretching exercise. Moreover, the post 14 shape may be configured to provide for optimal range of motion exercising.

Now referring to FIG. 7, and still generally referring to FIGS. 6-8, one embodiment of an apparatus 10 in accordance with the present invention for conducting compounded progressive stretching exercise may have multiple configurations of the upper extremity support 35. As depicted in FIG. 7, a post 14, may have an upper extremity support 35 capable of dynamic movement during a compounded progressive stretching exercise or be capable of undergoing movement and locking into a user-preferred, static position.

In one embodiment as shown generally in FIG. 7, an upper extremity support 35 may undergo upward movement 72 or downward movement 74. Movement of an upper extremity support 35 may be controlled by an adjustment knob 76 (e.g. lever, crank, turning wheel, thumb screw, etc.) capable of rotational movement 78. An adjustment knob 76 may lock an upper extremity support 35 into a pre-determined position or may allow for dynamic movement of an upper extremity support 35 during a compounded progressive stretching exercise. Dynamic movement of the upper extremity support 35 may be in an upward 79 or downward direction 80. Dynamic movement of the upper extremity support 35 may provide substantially more range of motion in a user during use of an apparatus 10. In addition, flexion of a post 14 and dynamic movement of an upper extremity support 35 may provide engagement of substantially more muscle groups to be relaxed and exercised at a given time.

Although not shown in FIG. 7, it is contemplated that an upper extremity support 35 may have substantially a "U" configuration or may be in any other configuration known to assist in supporting a user during operation of an apparatus 10. For example, and not by limitation, an upper extremity support 35 may be in a bicycle grip, steering wheel grip, or the like.

Likewise it is also contemplated within the scope of the invention that a post 14 may optionally include a strap or similar device to attach to a user and assist in conducting a range of motion exercise. A strap may be affixed to an upper extremity support 35 or top post 24 in a manner to optimize exercise and to provide user safety. In one embodiment, it may be preferable to replace an upper extremity support 35 with a flexible support 35, such as rope, strap or the like.

Specifically referring to FIG. 8, and generally referring to FIGS. 6-8, one embodiment of an apparatus 10 in accordance with the present invention for conducting compounded progressive stretching exercise may have multiple options for configuring a recoil assembly of a post 14. In one embodiment a spring 32 may be used to provide a recoil force to push a post 14 back toward a starting position. In practice, a spring 32 may be a type of steel, latex, synthetic rubber or plastic material, or the like that may be compressed, but is made from a substantially resilient material and will tend to return to normal position upon removal of an external force (i.e., when a user relaxes). The spring force to return to the rest or normal position may be measured by way of a spring constant, a durometer value, or the like.

As shown in FIG. 8, a spring 32 may be affixed to the top post 24 by a threaded screw or pin, thereby providing a mechanism for replacement of an elastomer spring 32 if it should become worn out. It is contemplated in alternative embodiments in accordance with the invention, that the spring 32 may be replaced with a coil spring 84, elastomeric block, or gas spring assembly 86. A gas spring assembly 86 may include a gas-filled piston, hydraulic damper, and the like. A recoil mechanism employing a spring 84, or a gas spring 86 may be formed of materials providing for a pre-determined recoil capability.

Figure 9:
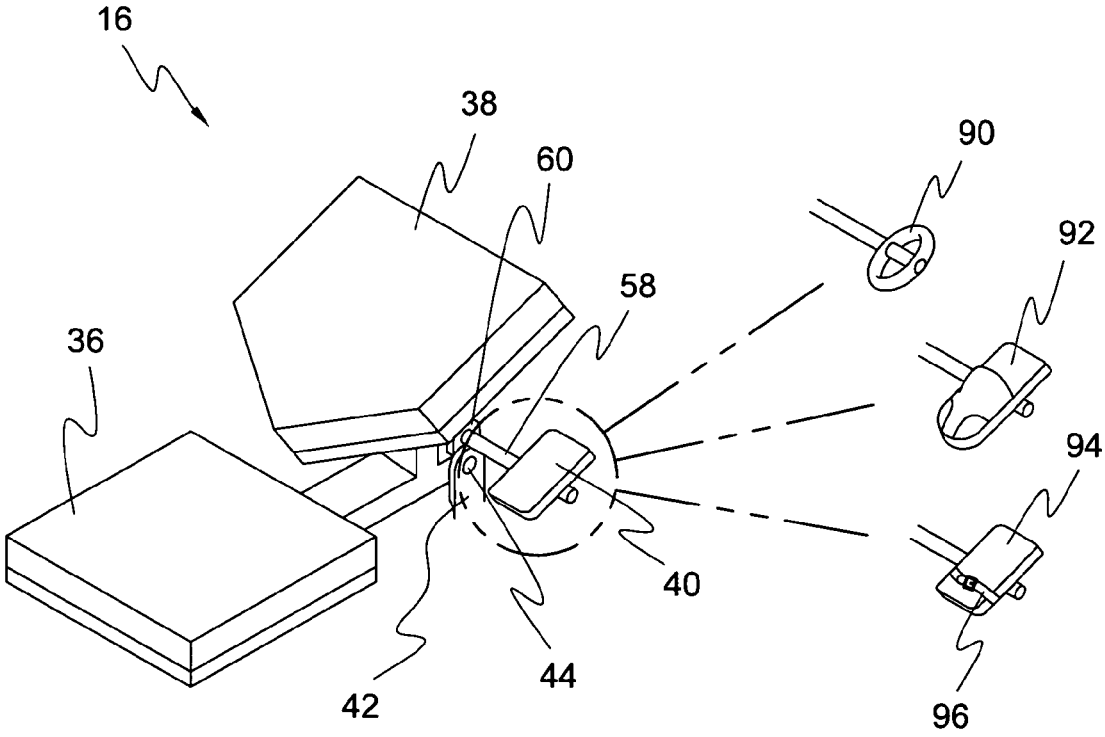
FIG. 9 is an exploded view of the user support assembly in one embodiment of an apparatus in accordance with the invention, illustrating alternative embodiments for foot support.

Referring specifically to FIG. 9, one embodiment of an apparatus 10 in accordance with the present invention for conducting compounded progressive stretching exercise may have multiple options for a foot support 40. In one embodiment a foot support 40 may be in the form of a plate 40. In alternative embodiments, a foot support 40 may formed as a standard bicycle pedal 90, a pedal cage 92, or pedal plate 94 with a strap 96. A strap 96 may be formed of any readily available material. A strap 96 may be joined and tightened by way of a clip, buckle, knot, hook and loop joiner, and the like.

Figure 10:
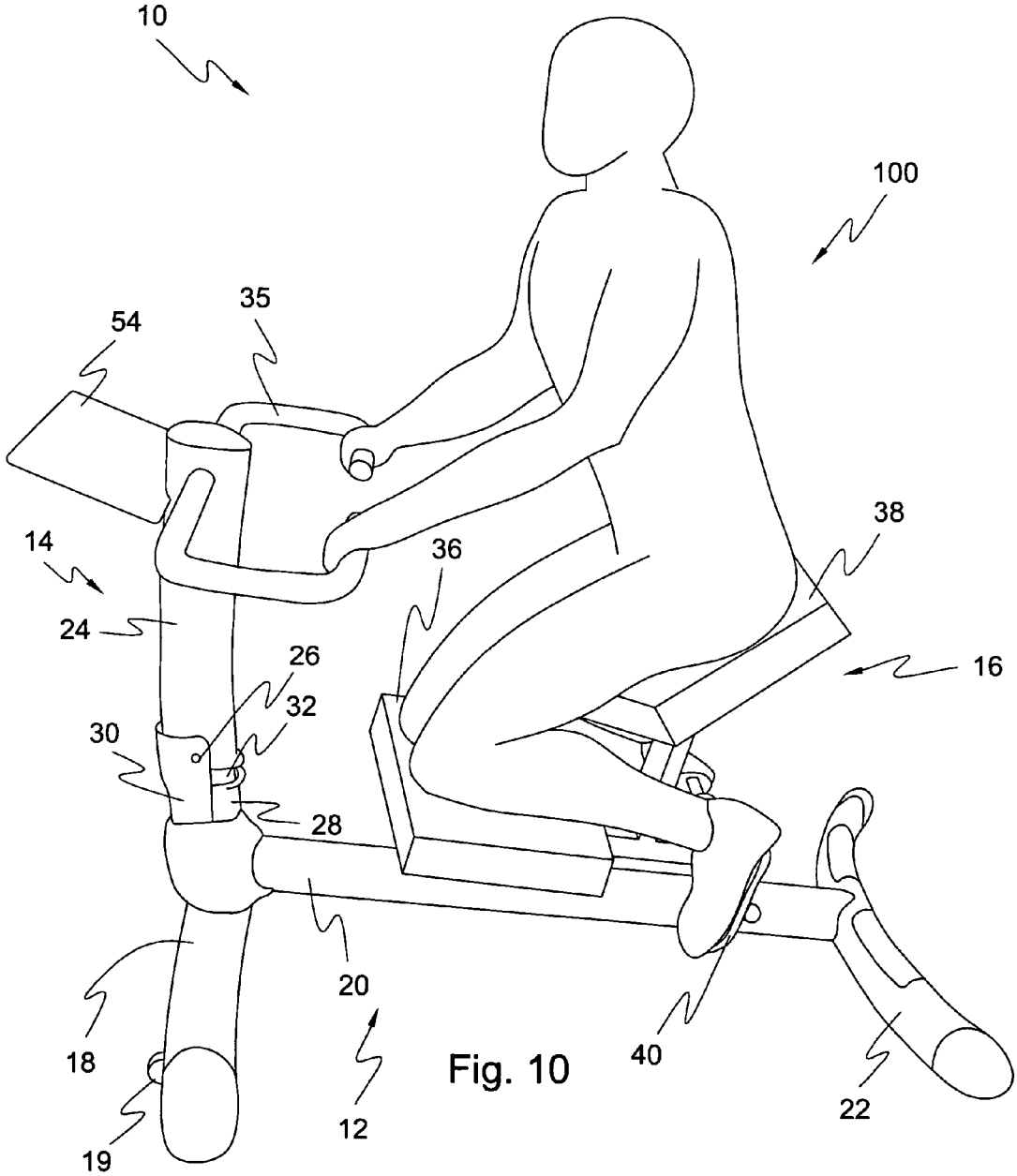
FIG. 10 is a left side perspective view of an apparatus in one embodiment in accordance with the invention, wherein a user is shown in position to begin a compounded progressive stretching exercise.

Now referring in general to FIGS. 10-14, and specifically to FIG. 10, one embodiment of an apparatus 10 in accordance with the present invention for conducting compounded progressive stretching exercise may include a frame support 12, post 14, and user assembly 16. In practice, a user 100 begins in a starting position, with knees resting on a forward support 36, buttocks resting on a rear support 38, hands and arms resting on an upper extremity support 35 and feet resting on at least one foot support 40. A user support assembly 16 is affixed to a medial frame 20 by a pivot bracket 42 and a pivot pin 44.

Figure 11:
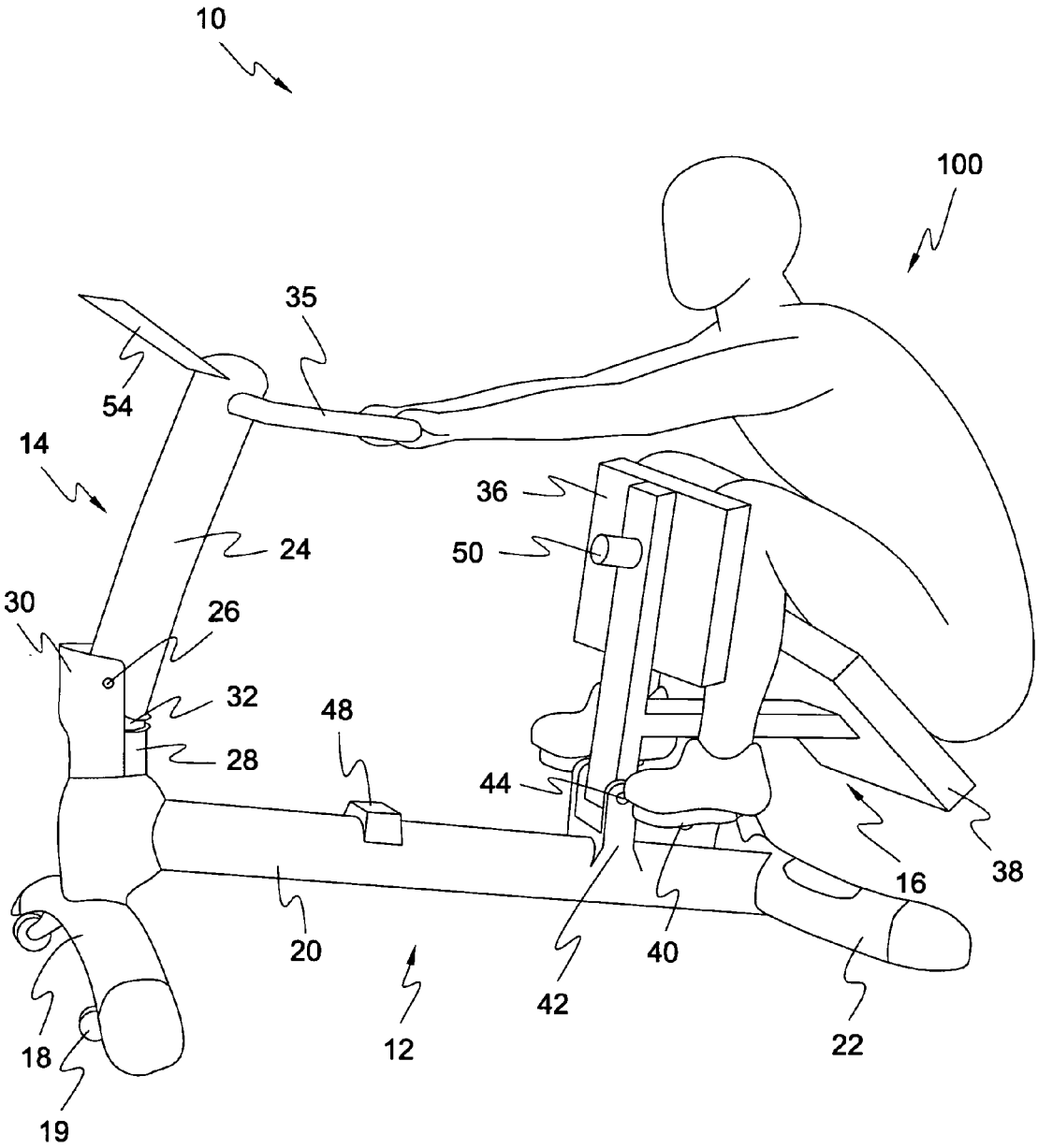
FIG. 11 is a left side perspective view of an apparatus in one embodiment in accordance with the invention, wherein a user is shown in full-back position in a compounded progressive stretching exercise.

Still referring in general to FIGS. 10-14, and now to FIG. 11, a user 100 may conduct a compounded progressive stretching exercise by shifting his or her center of gravity in a rearward and downward position causing flexion of the post 14 and rearward displacement of a support assembly 16. The user 100 moves substantially to the rear of the pivot bracket 42 and pivot pin 44. In this position, a user 100 is conducting a compounded progressive stretching exercise that may include the lower back region as well as several additional muscle groups at the same time. The groups stretching may be relaxed and not responsible for bearing a user's weight.

Figure 12:
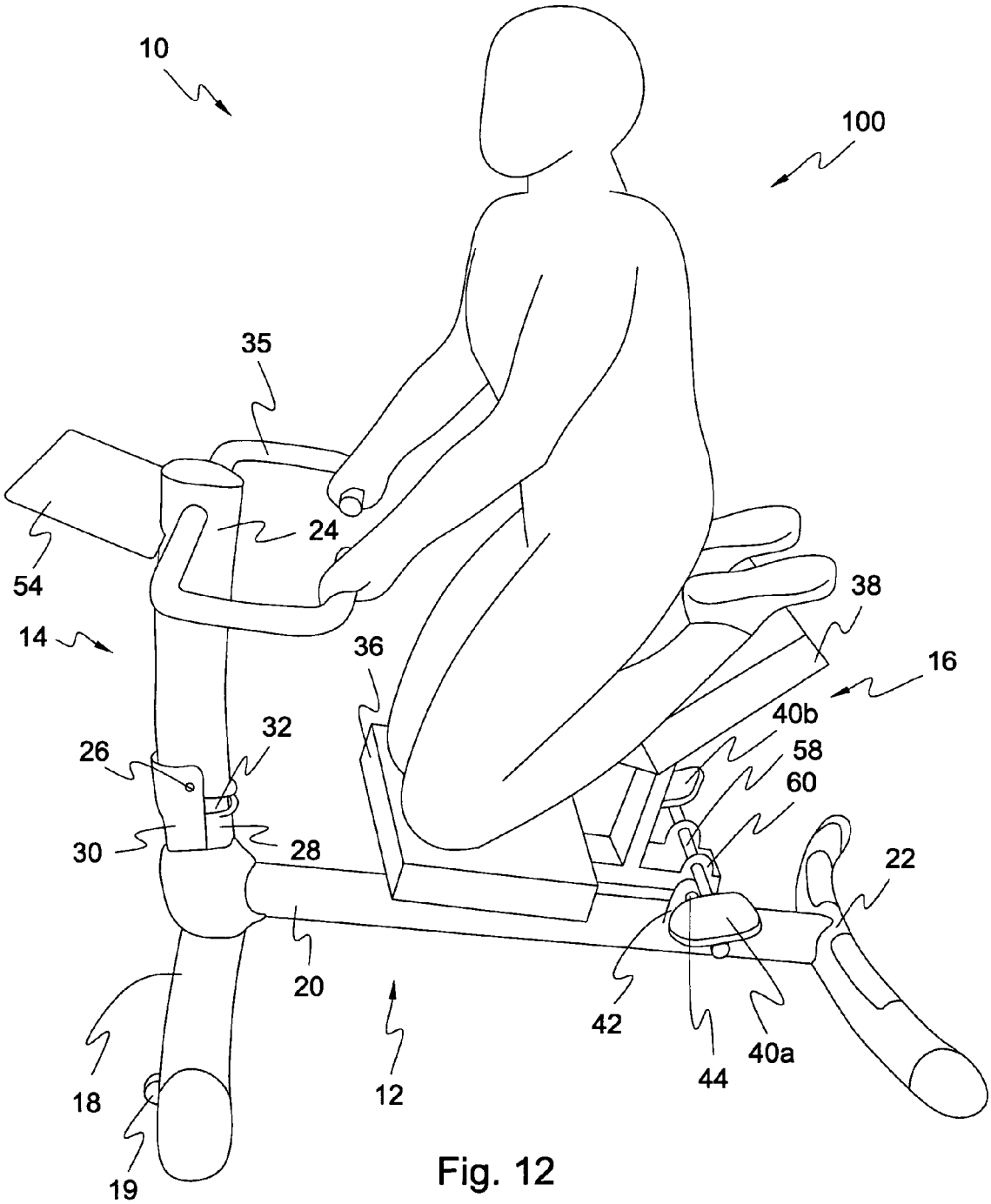
FIG. 12 is a left side perspective view of an apparatus in one embodiment in accordance with the invention, wherein a user is shown in an alternative kneeling position for conducting a compounded progressive stretching exercise.

Referring specifically to FIG. 12, and generally to FIGS. 10-14, one embodiment of an apparatus 10 in accordance with the invention for conducting compounded progressive stretching exercise may provide a user 100 with other configurations for stretching to improve the range of motion and flexibility in multiple muscle groups. As shown in FIG. 12, a user 100 may place buttocks and legs against the rear support 38 and conduct a stretching exercise. In this position, a user 100 may be stretching muscles in the abdominal, back, arms and leg areas.

Figure 13:
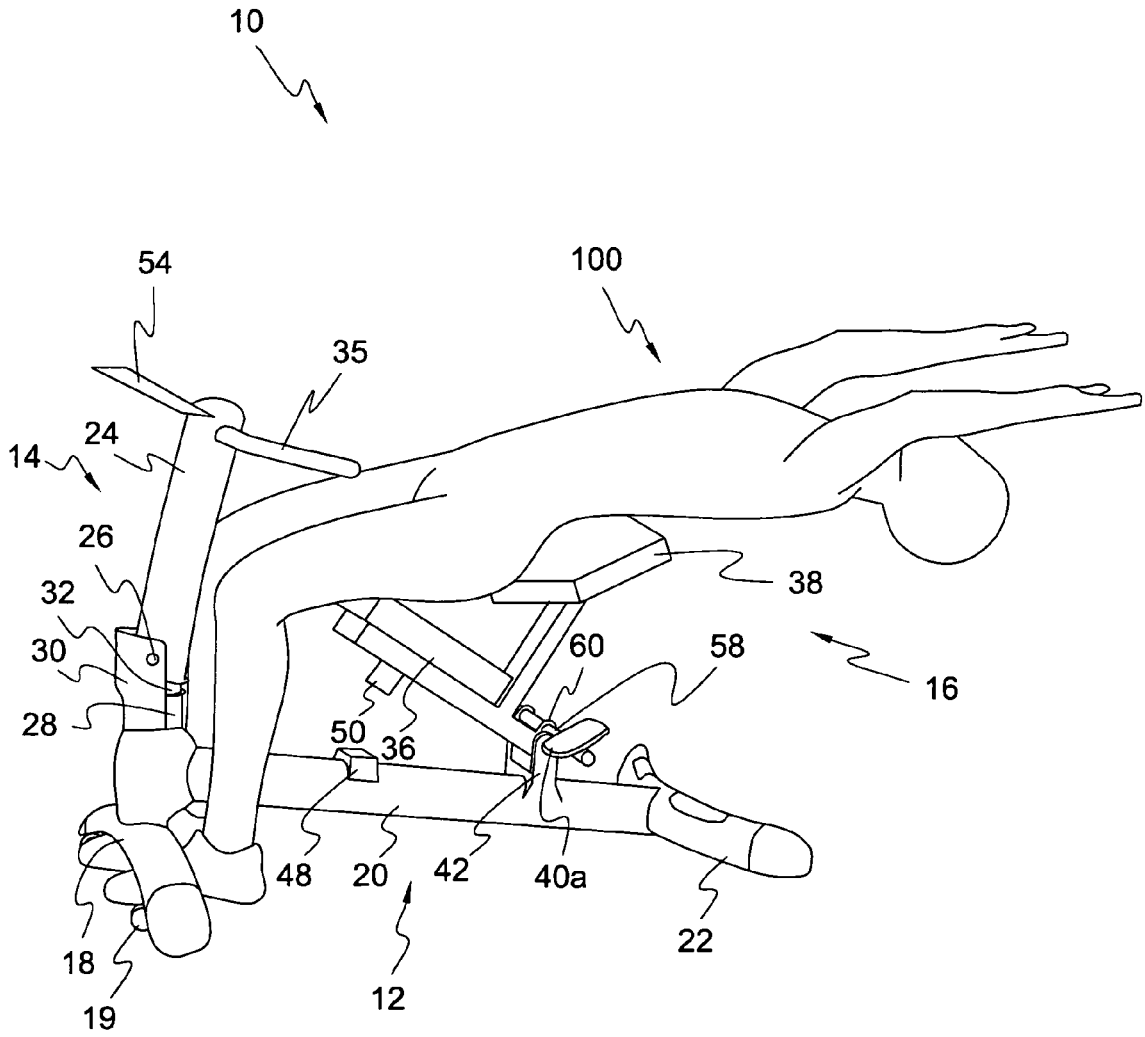
FIG. 13 is a left side perspective view of an apparatus in one embodiment in accordance with the invention, wherein a user is shown in an alternative half-back position for conducting a compounded progressive stretching exercise.

Referring specifically to FIG. 13, and generally to FIGS. 10-14, one embodiment of an apparatus 10 in accordance with the invention for conducting compounded progressive stretching exercise may include a user 100 locking his or her feet underneath the forward support 18 and placing their buttocks on the forward support 36 then conducting a backward displacement of arms and torso.

Figure 14:
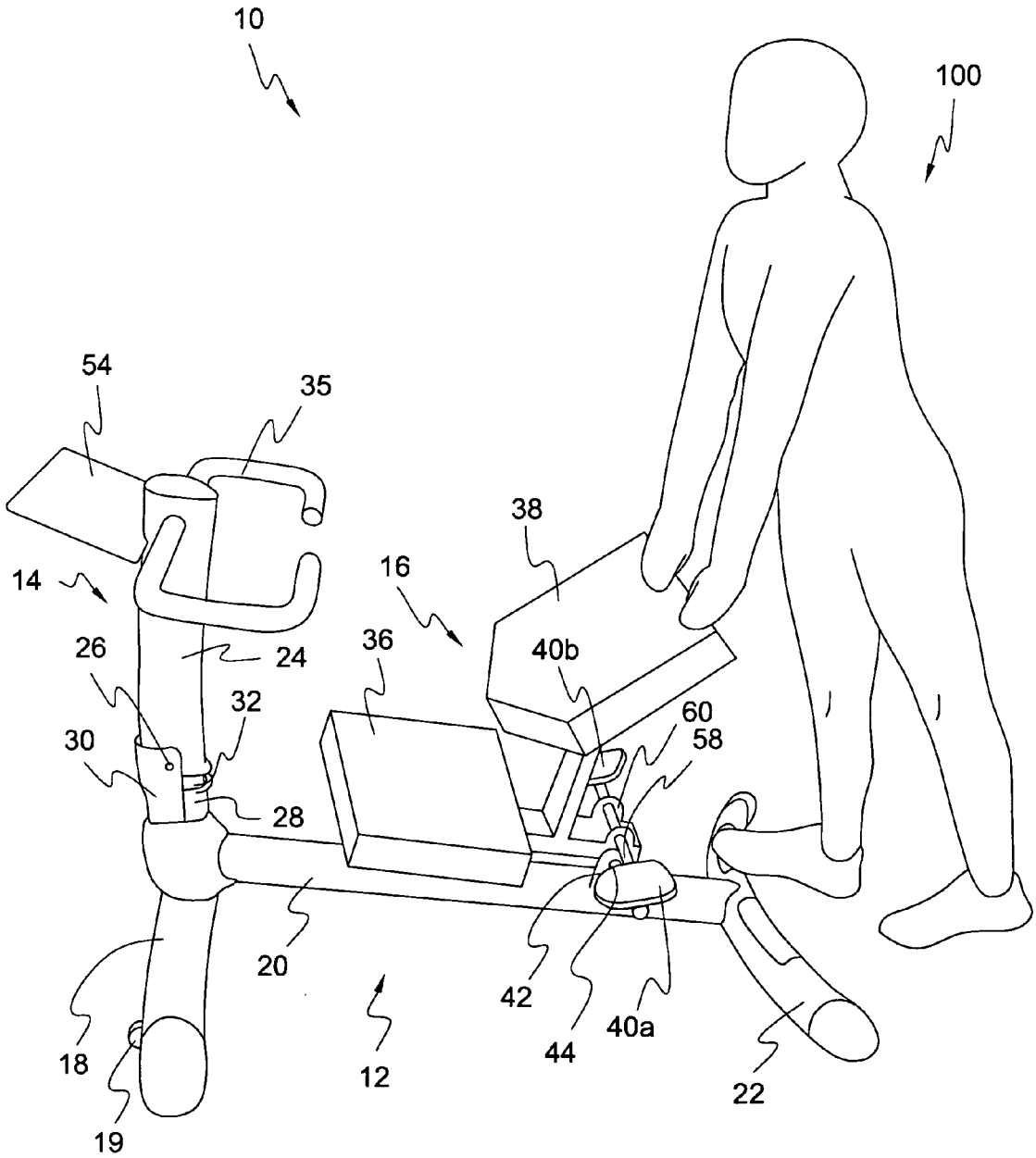
FIG. 14 is a left side perspective view of an apparatus in one embodiment in accordance with the invention, wherein a user is shown in an alternative position for conducting a compounded progressive stretching exercise of the calf or leg muscles.

Referring specifically to FIG. 14, and generally to FIGS. 10-14, in yet another embodiment of an apparatus 10 in accordance with the invention for conducting compounded progressive stretching exercise, a user 100 may conduct a calf and leg stretching exercise by using the rear support 22 of the base frame 12. A user 100 may use the rear support 38 for support of upper extremities.

Figure 15A:
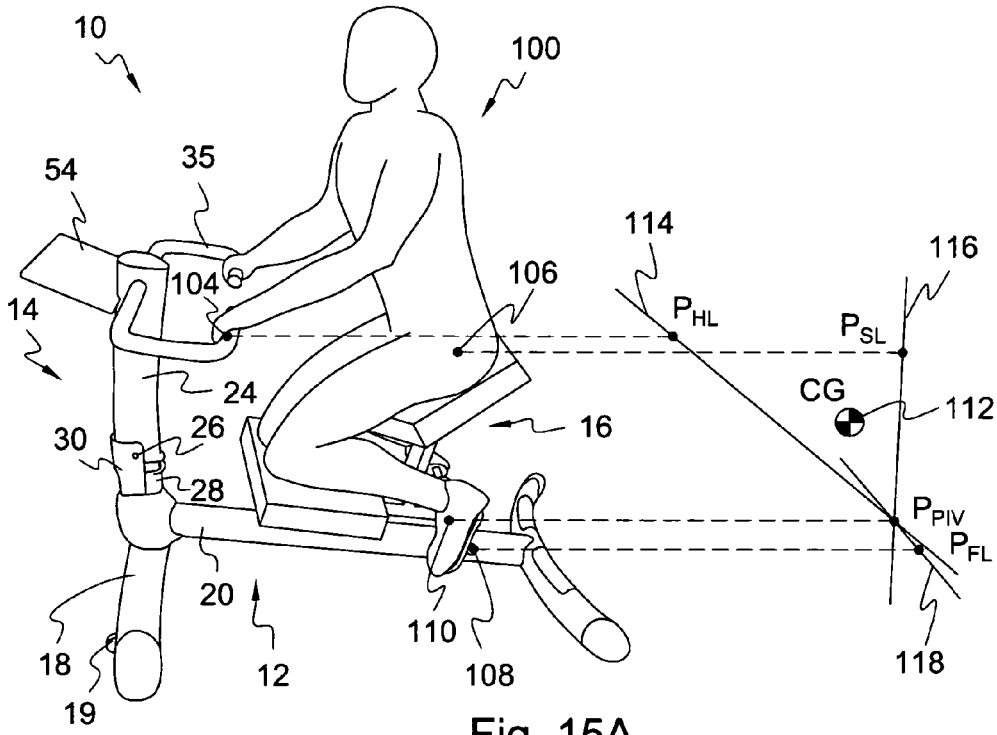
FIGS. 15A and 15B are left side perspective views of an apparatus in one embodiment in accordance with the invention, wherein a user is shown in a starting position and a full-back position, respectively, for conducting a compounded progressive stretching exercise, in addition, the relative changes in user center of gravity and corresponding changes in pivot points are illustrated to describe the dynamic qualities of the present invention.
Figure 15B:
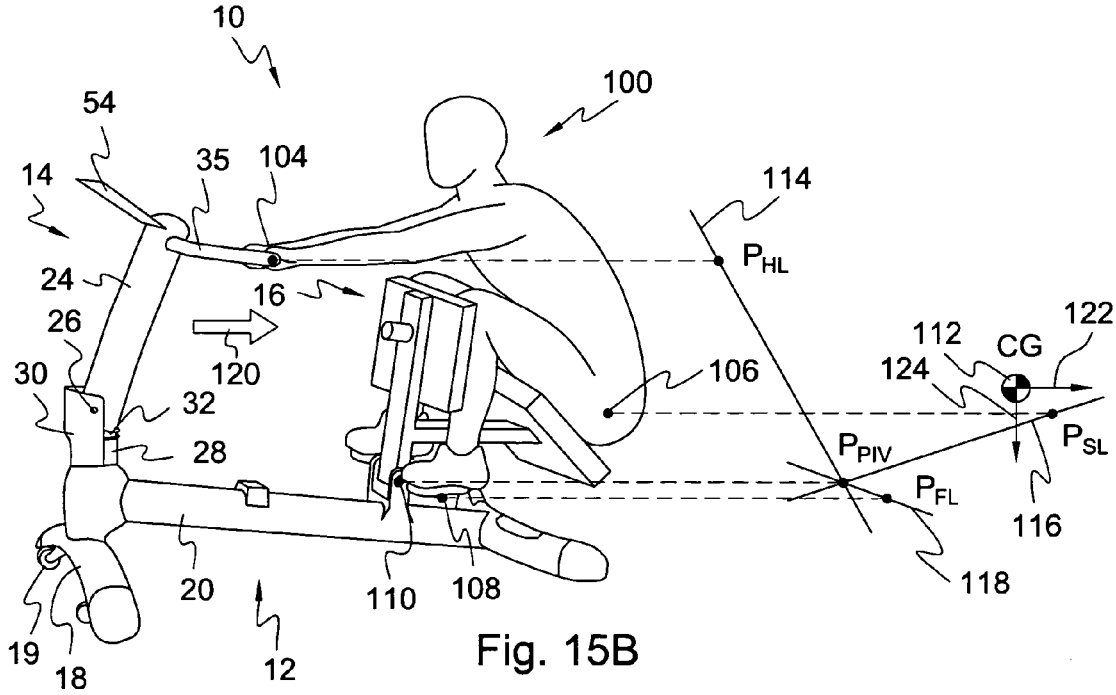

Now referring specifically to FIG. 15, one embodiment of an apparatus 10 in accordance with the invention for conducting compounded progressive stretching exercise may employ a change in a user's 100 center of gravity 112 to conduct a stretching exercise. In practice a user 100 has four primary anatomical points where force loads may be created. A user may have a hand load 104, a seat load 106, a foot load 108, and a pivot load 110. The pivot load 110 may form three separate vectors in relation to the foot load 104, seat load 106, and foot load 108. A first vector 114 may be formed between the hand load 104 and the pivot load 110. A second vector 116 may be formed between the seat load 106 and pivot load 110. A third vector 118 may be formed between the foot load 108 and the pivot load 110.

In practice, a user 100 may conduct a compounded progressive stretching exercise by initiating a rear displacement 120 of a post 14 and a user assembly 16 such that a user's 100 center of gravity 112 is displaced in a rearward 122 and a downward 124 direction. As shown in FIG. 15 a user 100 has shifted nearly his or her effective center of mass from in front of the pivot pin 44 to a position behind the pivot pin 44. In addition, the user 100 has shifted their upper extremity position substantially to the rear. In general, no portion of the user 100 has remained in a fixed or otherwise anchored position. This is a substantial departure from the structures and methods of the available prior art.

Figure 16:
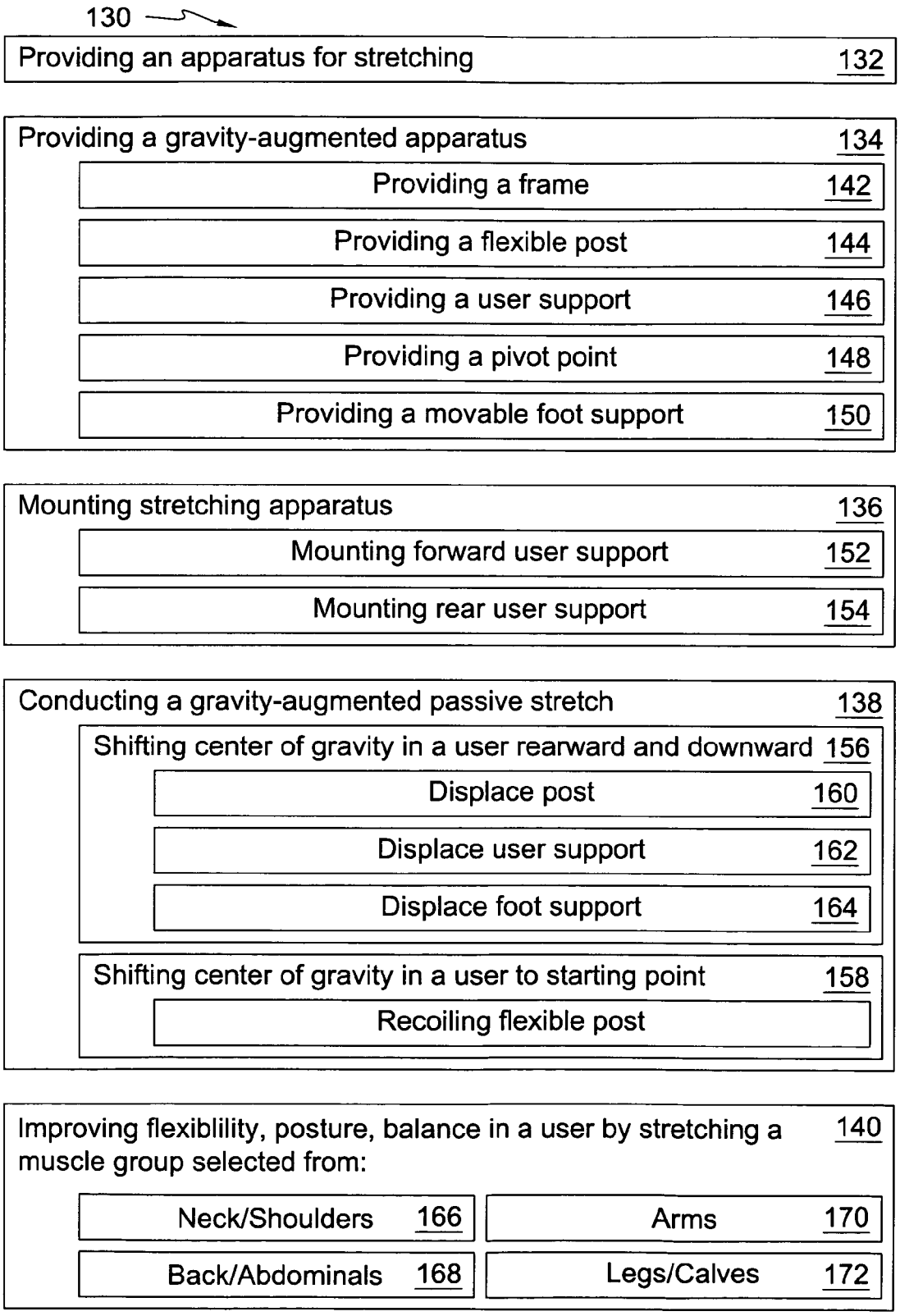
FIG. 16 is a schematic block diagram illustrating one embodiment of a method for improving flexibility in a user by conducting compounded progressive stretching exercise in accordance with the invention.
Figure 17:
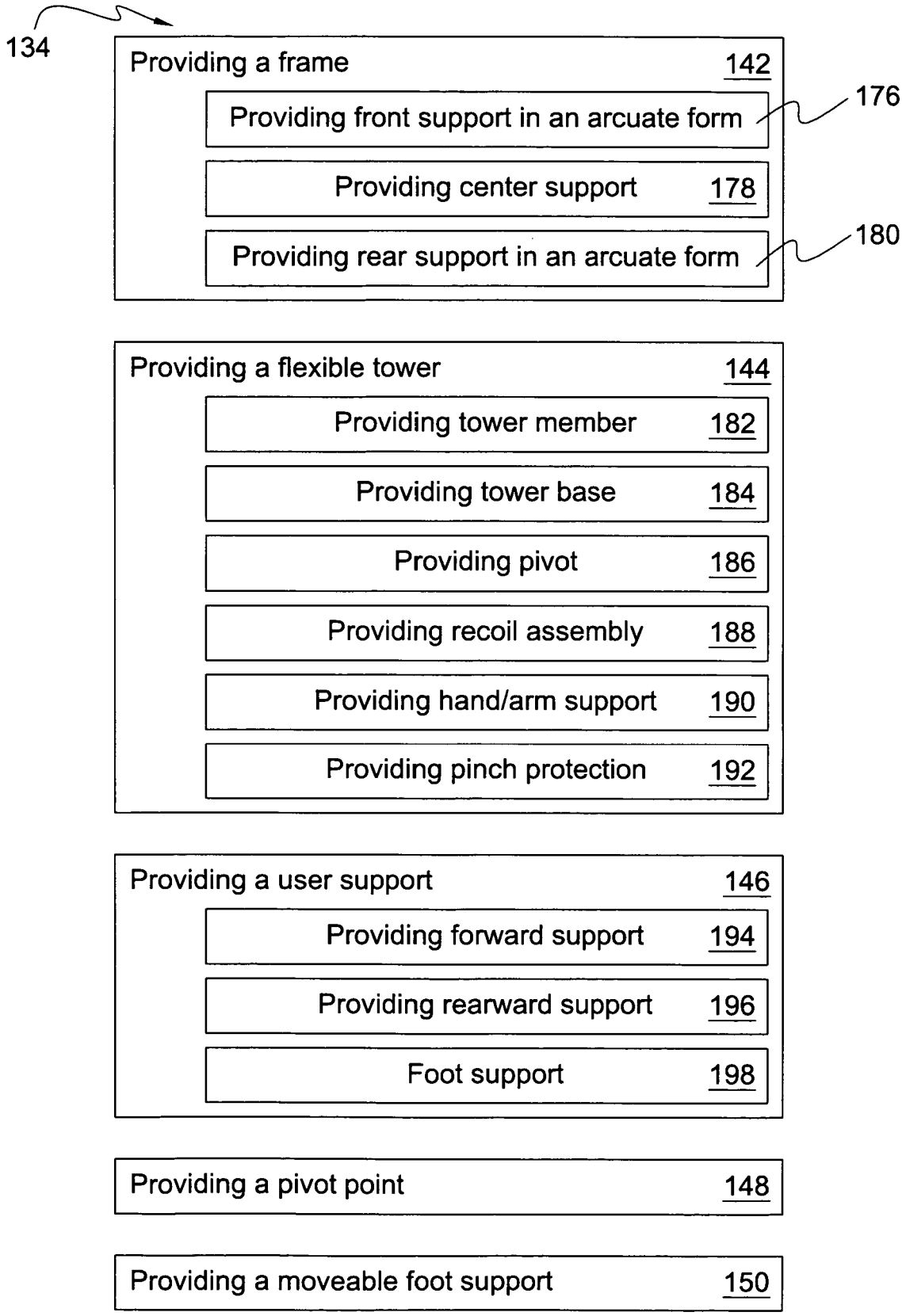
FIG. 17 is a schematic block diagram illustrating one embodiment of a method for providing a gravity-augmented passive stretching exercise apparatus in accordance with the invention.

Generally referring to FIGS. 16-17, and specifically to FIG. 16, one embodiment of a method 130 in accordance with the invention for conducting compounded progressive stretching exercise may include the steps of providing an apparatus for compounded progressive stretching 132, providing a gravity-augmented passive stretching apparatus 134, mounting a gravity-augmented passive stretching apparatus 136, conducting a gravity-augmented passive stretch, and improving flexibility, posture, and balance in a user by conducting a gravity-augmented, passive, stretching exercise 140.

The step of providing a gravity-augmented passive stretching apparatus 134 may further include the steps of providing a frame 142, providing a flexible post 144, providing a user support 146, providing a pivot point 148, and providing a moveable foot support 150. In addition, the step of mounting a gravity-augmented passive stretching apparatus 136 may further include the steps of mounting a forward user support 152 and mounting a rear user support 154. A user 100 may mount a user support by placing any portion of the user's body in contact with the user support. In addition, a user 100 may not have to mount both a forward user support 152 and a rear user support 154 in order to suitably mount a gravity-augmented passive stretching apparatus 136.

The step of conducting a gravity-augmented passive stretch 138 may include the steps of shifting the center of gravity of a user in a rearward and downward direction 156 and shifting the center of gravity of a user back to the starting point 158. The step of shifting the center of gravity rearward and downward 156 may include displacement of a post 160, displacement of a user support 162, and displacement of a foot support 164. The step of shifting center of gravity to starting point 158 may include the step of a flexible post 14 recoiling to a starting position 165.

The step of improving flexibility, posture, and balance in a user 140, may include stretching a muscle group selected from the group of neck/shoulders 166, back/abdomen 168, arms/upper extremity 170, and legs/calves 172. These muscles groups may be stretched independently or at the same time depending the position of the user 100.

Still referring generally to FIGS. 16-17, and specifically to FIG. 17, the step of providing a gravity-augmented passive stretching apparatus 134 may include the steps of providing a frame 142, providing a flexible post 144, providing a user support 146, providing a pivot point 148, and providing a moveable foot support 150. The step of providing a frame 142 may further include the steps of providing a front support in an arcuate form 176, providing a center or medial support 178, and providing a rear support in an arcuate form 180.

In addition, the step of providing a flexible post 144 may further include the steps of providing a top post 182, providing a bottom post 184, providing a pivot 186, providing a recoil assembly 188, providing an upper extremity support 190, and providing pinch protection 192. Moreover, the step of providing a user support 146 may further include the steps of providing a forward support 194, providing a rear support 196, and providing a foot support 198.

The present invention may be embodied in other specific forms without departing from its function, structure, or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for improving flexibility in a user, the apparatus comprising:

a frame comprising a forward lateral support, a medial support, and a rear lateral support;

a user support assembly comprising a forward support and rear support, pivotable about an axis of rotation to support movement of a user about the axis of rotation during passive stretching exercises, and a foot support;

a post assembly extending away from the frame and comprising a handlebar, a resilient member, and a vertical member extending between the resilient member and handlebar to move dynamically, between a starting, equilibrium position and a maximum extension position, with upper extremities of a user during passive stretching exercises; and the post assembly further comprising a bottom section fixed to the frame, a pivot connecting the vertical member to the bottom section, a protection sleeve connected to at least one of the vertical member and bottom section proximate the pivot to resist insertion of objects and bodily members, and a stop stopping relative motion between the bottom section and the vertical member to define the equilibrium position, the resilient member biasing the vertical member toward the equilibrium position.

2. The apparatus of claim 1, wherein the foot support comprises a pivot having a foot axis of rotation distinct from the axis of rotation of the front and rear support.

3. The apparatus of claim 1, wherein the resilient member comprises a spring selected from the group consisting of an elastomer, a reinforced polymer, a metal spring, and a gas-filed piston.

4. The apparatus of claim 3, wherein the spring comprises an elastomer removably secured between the vertical member and the bottom section.

5. The apparatus of claim 3, wherein the spring has an effective spring constant of from about 25 pounds per inch to about 10,000 pounds per inch of displacement thereof.

6. The apparatus of claim 1, wherein the post assembly and user support are positioned with respect to one another to passively stretch a muscle group selected from the group consisting of neck, shoulder, back, abdominal, arm, leg, and calf muscles.

7. The apparatus of claim 1, wherein the post assembly and user support are positionable with respect to one another and a user to define a center of gravity moveable between a first, neutral position forward of the axis of rotation and a second extended position wherein the center of gravity is behind the axis of rotation.

8. The apparatus of claim 1, wherein the frame and post assembly are constructed from a material selected from the group consisting of metal, wood, polymer, and reinforced polymer.

9. The apparatus of claim 1, wherein the front and rear user supports are removably covered with a resilient pad.

10. The apparatus of claim 1, further comprising a media support to support at least one of instructional materials, newspapers, books, magazines, a video monitor, and a computer monitor.

11. An apparatus for improving flexibility in a user, the apparatus comprising:

a frame having a forward lateral support, a medial support, and a rear lateral support;

a post assembly having a top section, an upper extremity support graspable by a hand of a user, a bottom section, a pivot, a pinch protection sleeve and a recoil assembly, the flexible post pivotably between a forward, neutral position urged by the recoil assembly when not loaded by a user, and a rearward extended position when loaded by a portion of the weight of a user during a stretching exercise; and a user support assembly having a forward support and rear support pivotably about an axis to move a center of gravity of a user from a rest position ahead of the axis to a stretching position behind the axis during stretching of at least one muscle group selected from neck, shoulder, back, abdominal, arm, leg, and calf muscles.

12. A method for improving flexibility in a user, the method comprising:

providing an apparatus having frame, a user support pivotably with respect thereto about an axis of rotation, to support the bulk of weight of a user during stretching, and a post assembly comprising a post pivotably with respect to the frame and against a resilient member, the post positioned forward of the user support and comprising a handlebar for grasping by a user to control positioning of the center of gravity of a user on the user support, the post assembly including a top section, a bottom section, a pivot, and a protection sleeve to resist entry of objects and bodily extremities thereinto;

mounting the apparatus, with the center of gravity of a user positioned forward of the axis of rotation, and grasping the handlebar positioned in a starting neutral position;

pushing against the handlebar to initiate pivoting of the user support rearward to move the center of gravity of the user to a position behind the axis of rotation;

displacing the handlebar, pivoting the post assembly rearward to further rotate the user support about the axis of rotation to augment passive stretching with the force of gravity, on a user;

pulling against the handlebar to shift the center of gravity forward of the axis of rotation; and returning the handlebar to the starting neutral position.

13. The method of claim 12, wherein the frame further comprises a front lateral support, a medial support, and a rear lateral support.

14. The method of claim 12, further comprising shifting the center of gravity of a user downward by displacing the post and user support.

15. The method of claim 12, wherein stretching comprises extending a range of motion of a body member limited by at least one of neck, shoulder, back, abdominal, arm, leg, and calf muscle groups.

16. An apparatus for improving flexibility in a user, the apparatus comprising:

a frame;

a user support pivotably connected to the frame to pivot a user about an axis during passive stretching exercises;

a post assembly comprising a post, a pivot connecting the post to the frame, and a handlebar connected to the post, the, post pivoting with respect to the frame through a range of motion bounded by a starting position and a fully deflected position; and the post assembly further comprising a resilient member biasing the post toward the starting position.

* * * * *